US006147445A

United States Patent [19]

Jager et al.

[11] Patent Number: 6,147,445

[45] Date of Patent: Nov. 14, 2000

[54] UNIFORMIZATION OF THE ELECTRON EMISSION OF A FLAT SCREEN MICROTIP CATHODE

[75] Inventors: Axel Jager, Sussargues; Christian Torrent, Montpellier, both of France

[73] Assignee: Pixtech S.A., Rousset, France

[21] Appl. No.: 09/049,364

[22] Filed: Mar. 27, 1998

[30] Foreign Application Priority Data

Mar. 28, 1997 [FR] France ..... 97 04097

[51] Int. Cl.[7] ..... H01J 1/30

[52] U.S. Cl. ..... 313/336; 313/309; 313/351; 313/495

[58] Field of Search ..... 313/495, 497, 313/309, 336, 351

[56] References Cited

U.S. PATENT DOCUMENTS 5,557,159 9/1996 Taylor et al. ..... 313/336

*Primary Examiner*—Ashok Patel
*Attorney, Agent, or Firm*—Arthur L. Plevy; Buchanan Ingersoll PC

[57] ABSTRACT

The present invention relates to a flat display screen cathode of the type including, on a substrate, columns of cathode conductors which can be biased individually and associated with a resistive layer on which are deposited electron emission microtips, and including means for canceling a possible lateral electric field between two neighboring columns brought to different potentials.

10 Claims, 4 Drawing Sheets

UNIFORMIZATION OF THE ELECTRON EMISSION OF A FLAT SCREEN MICROTIP CATHODE

BACKGROUND OF THE INVENTION

1. Field of the Invention

The present invention relates to the implementation of a microtip cathode of a flat display screen.

2. Discussion of the Related Art

FIG. 1 shows an example of conventional structure of a flat color microtip screen.

Such a microtip screen is essentially formed of a cathode 1 with microtips 2 and of a grid 3 provided with holes 4 corresponding to the locations of microtips 2. Cathode 1 is placed facing a cathodoluminescent anode 5, a glass substrate of which generally forms the screen surface.

Cathode 1 is organized in columns and is formed, on a glass substrate 10, of cathode conductors organized in meshes from a conductive layer. Microtips 2 are made on a resistive layer 11 deposited on the cathode conductors and are arranged within the meshes defined by the cathode conductors. FIG. 1 partially shows the inside of a mesh and the cathode conductors do not appear on the drawing. Cathode 1 is associated with grid 3 organized in lines. The intersection of a line of grid 3 and of a column of cathode 1 defines a pixel.

This device uses the electric field created between cathode 1 and grid 3 to extract electrons from microtips 2. These electrons are then attracted by phosphor elements 7 of anode 5 if these elements are properly biased. In the case of a color screen such as shown in FIG. 1, anode 5 is provided with alternate strips of phosphor elements 7*r*, 7*g*, 7*b*, each corresponding to a color (Red, Green, Blue). The strips are parallel to the cathode columns and are separated from one another by an insulator 8. Phosphors 7 are deposited on electrodes 9, formed of corresponding strips of a transparent conductive layer such as indium and tin oxide (ITO). The sets of red, green, blue strips are alternately biased with respect to cathode 1, so that the electrons extracted from the microtips 2 of a pixel of the cathode/grid are alternately directed to the phosphor elements 7 facing each of the colors.

In the case of a monochrome screen (not shown), the anode is formed of a plane of phosphor elements of same color or of two sets of alternate strips of phosphor elements of same color.

FIGS. 2A and 2B schematically illustrate the meshing of the cathode conductors of such a microtip screen. FIG. 2A partially shows in top view a microtip cathode and FIG. 2B is a cross-sectional view along line B-B' of FIG. 2A. For clarity, the grid (3, FIG. 1) and the insulating layer between this grid and the resistive layer (11, FIG. 1) have not been shown in FIGS. 2A and 2B.

Several microtips 2, for example, 16, are arranged in each mesh 12 defined by cathode conductors 13. Although a reduced number of meshes has been shown for each pixel 14 defined by the intersection of a column 15 of cathode 1 and of a line of the grid (not shown), it should be noted that the microtips generally are as many as several thousands per screen pixel.

Cathode 1 is generally formed of layers successively deposited on glass substrate 10. A conductive layer 13, for example, made of niobium, is deposited on substrate 10. This layer 13 is etched according to the pattern of columns 15, each column including meshes 12 surrounded with cathode conductors 13. A resistive layer 11 is then deposited on cathode conductors 13. Resistive layer 11, formed, for example, of phosphorous-doped amorphous silicon, has the object of protecting each microtip 2 against a current excess at the starting of a microtip 2. The addition of such a resistive layer 11 aims at homogenizing the electron emission of the microtips 2 of a pixel of cathode 1 and thus at increasing its lifetime. The resistive layer may be etched according to the column pattern and/or opened, at least partially, above the cathode conductors. An insulating layer (not shown), for example in silicon oxide ($SiO_2$), is deposited on resistive layer 11 to insulate cathode conductors 13 of grid 3 (FIG. 1). A microtip cathode of this type is described, for example, in European patent application n° 0696045.

If desired, cathode conductors 13 may be deposited on resistive layer 11 which may, as in the preceding case, be a full plate layer or not. A microtip cathode of this type is described, for example, in French patent application n° 2722913.

A disadvantage of conventional screens is that, along the screen operation, differences in brightness can be observed from one column of the screen to another, which are due, in particular, to a drift in the amount of electrons emitted by the cathode microtip columns for a given luminance reference. This phenomenon which occurs both for color screens and for monochrome screens results in the appearing of over-bright columns independently from the image pattern to be displayed.

SUMMARY OF THE INVENTION

The present invention aims at overcoming this disadvantage by making the screen brightness substantially uniform from one column to another.

To achieve this object, the present invention provides a flat display screen cathode of the type including, on a substrate, columns of cathode conductors which can be biased individually and associated with a resistive layer on which are deposited electron emission microtips, and including means for canceling a possible lateral electric field between two neighboring columns brought to different potentials.

According to an embodiment of the present invention, the cathode includes, between two neighboring columns, an inter-column conductive track likely to be biased to a potential at most equal to the minimum biasing potential of the cathode conductors.

According to an embodiment of the present invention, the inter-column conductive tracks are interconnected by one end.

According to an embodiment of the present invention, the cathode includes an insulating layer formed on the cathode conductors associated with the resistive layer, a grid conductive layer organized in lines being deposited on the insulating layer opened above each inter-column track.

According to an embodiment of the present invention, the insulating layer is also opened, at least partially, above the cathode conductors.

According to an embodiment of the present invention, the inter-column tracks are deposited directly on the substrate and are made of the same material as the cathode conductors.

According to an embodiment of the present invention, the inter-column tracks are deposited directly on the substrate and are made of the same material as that of the resistive layer.

According to an embodiment of the present invention, the cathode includes a back-electrode deposited at the rear surface of the substrate.

According to an embodiment of the present invention, the back-electrode is formed of a conductive plane, extending over the entire surface of the cathode and likely to be biased to a strongly positive potential.

According to an embodiment of the present invention, the back-electrode is coated with a protection layer.

The present invention originates from an interpretation of the phenomena which cause the above-mentioned problems in conventional screens.

The inventor considers that these problems result, in particular, from a modification of the resistivity of the layer (11, FIGS. 1 and 2B) on which are deposited the cathode microtips.

In a conventional screen, when a given column is biased for a maximum emission (for example, at 0 V) and the neighboring column is biased for no emission (for example, +30 V), a lateral electric field is created between the two columns, the field lines of which leave from the positively biased column and cross the glass substrate to reach the neighboring zero potential column.

This electric field modifies the resistivity of the resistive layer of the zero potential column, which causes a modification of the amount of electrons emitted by the microtips of this column under a given brightness reference.

Besides the fact that the decrease in the resistivity of the layer supporting the microtips causes an increase in the brightness of the considered column by an increase of the current of the microtips of this column, the corresponding resistive layer can then no longer perform its function of microtip protection and short-circuits appear between the grid and the cathode.

Based on this analysis, the present invention provides to cancel the lateral inter-column field.

The foregoing objects, features and advantages of the present invention, will be discussed in detail in the following non-limiting description of specific embodiments in connection with the accompanying drawings.

DETAILED DESCRIPTION

The same elements have been referred to with the same references in the different drawings. For clarity, the representations of the drawings are not to scale.

Figure 1:
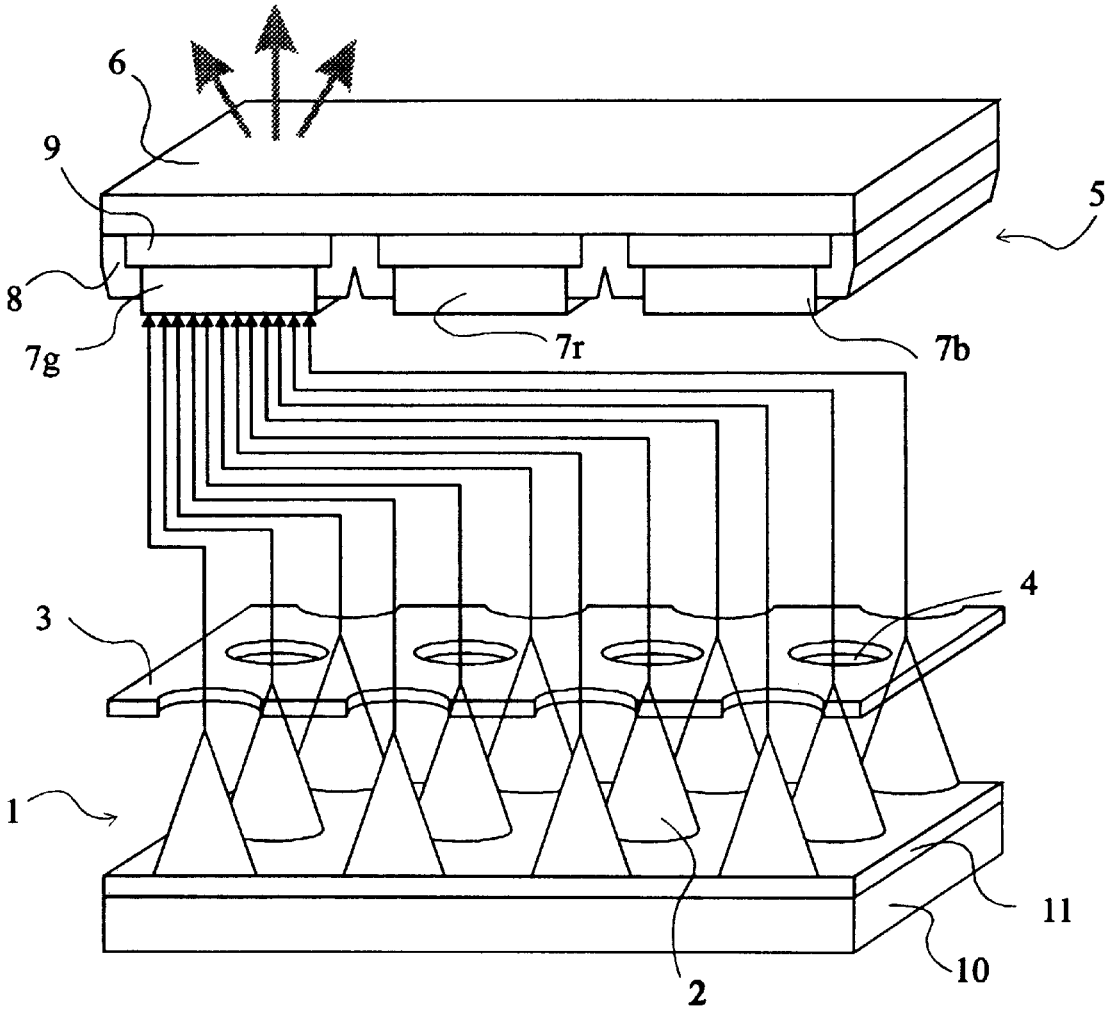
FIGS. 1, 2A and 2B, previously described, are meant to show the state of the art and the problem to solve.
Figure 2A:
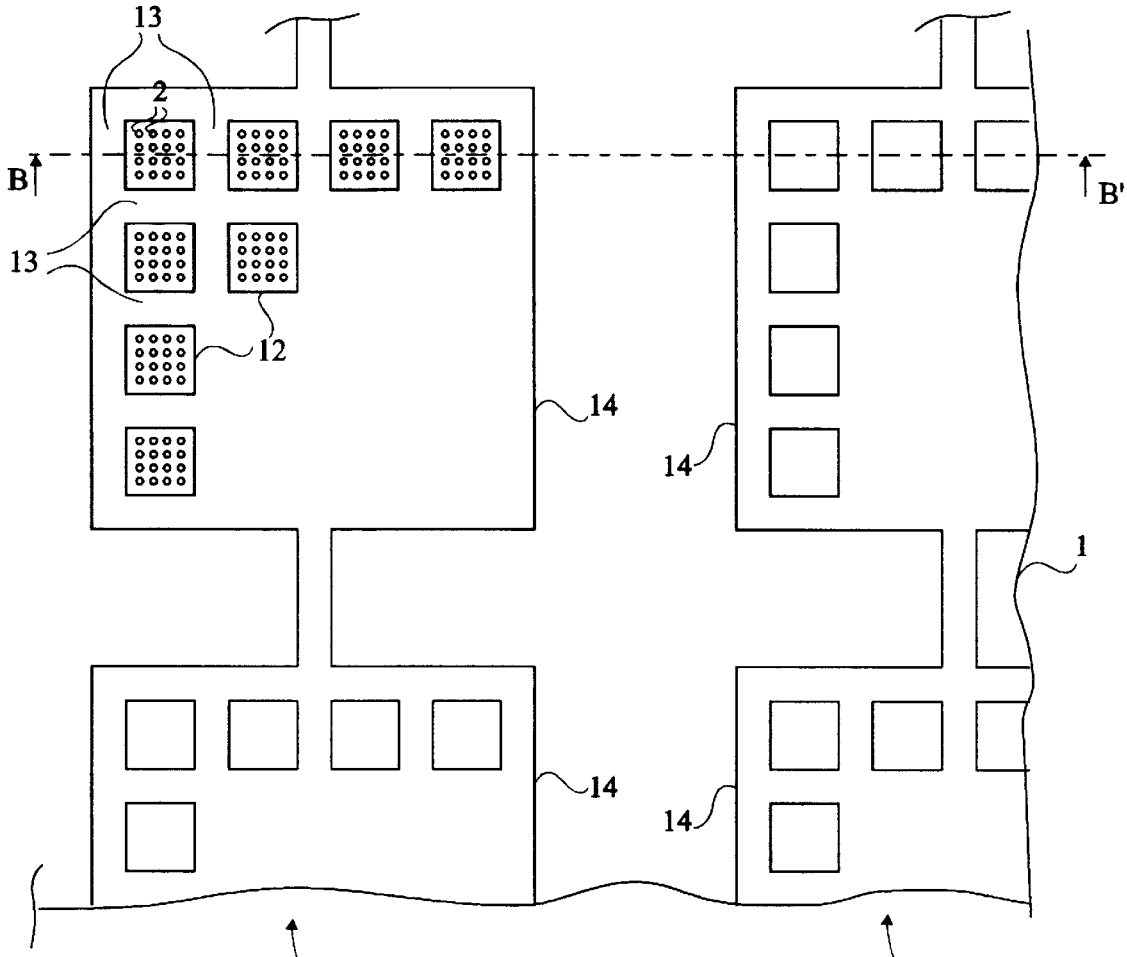
Figure 2B:
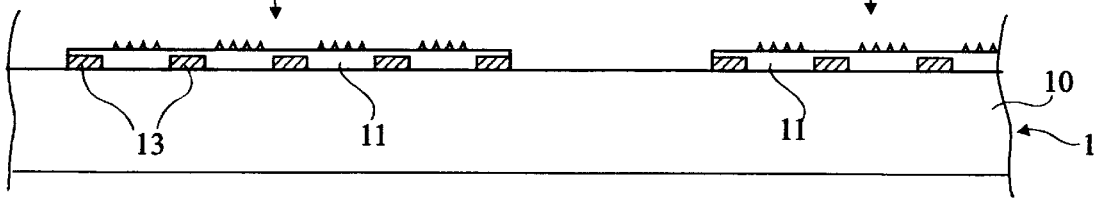
Figure 3:
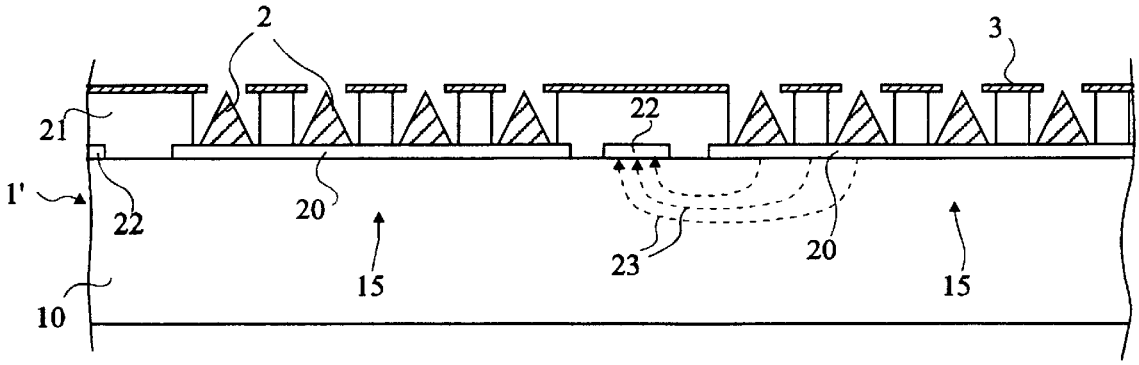
FIG. 3 shows in cross-sectional view a first embodiment of a flat display microtip screen according to the present invention.
Figure 4:
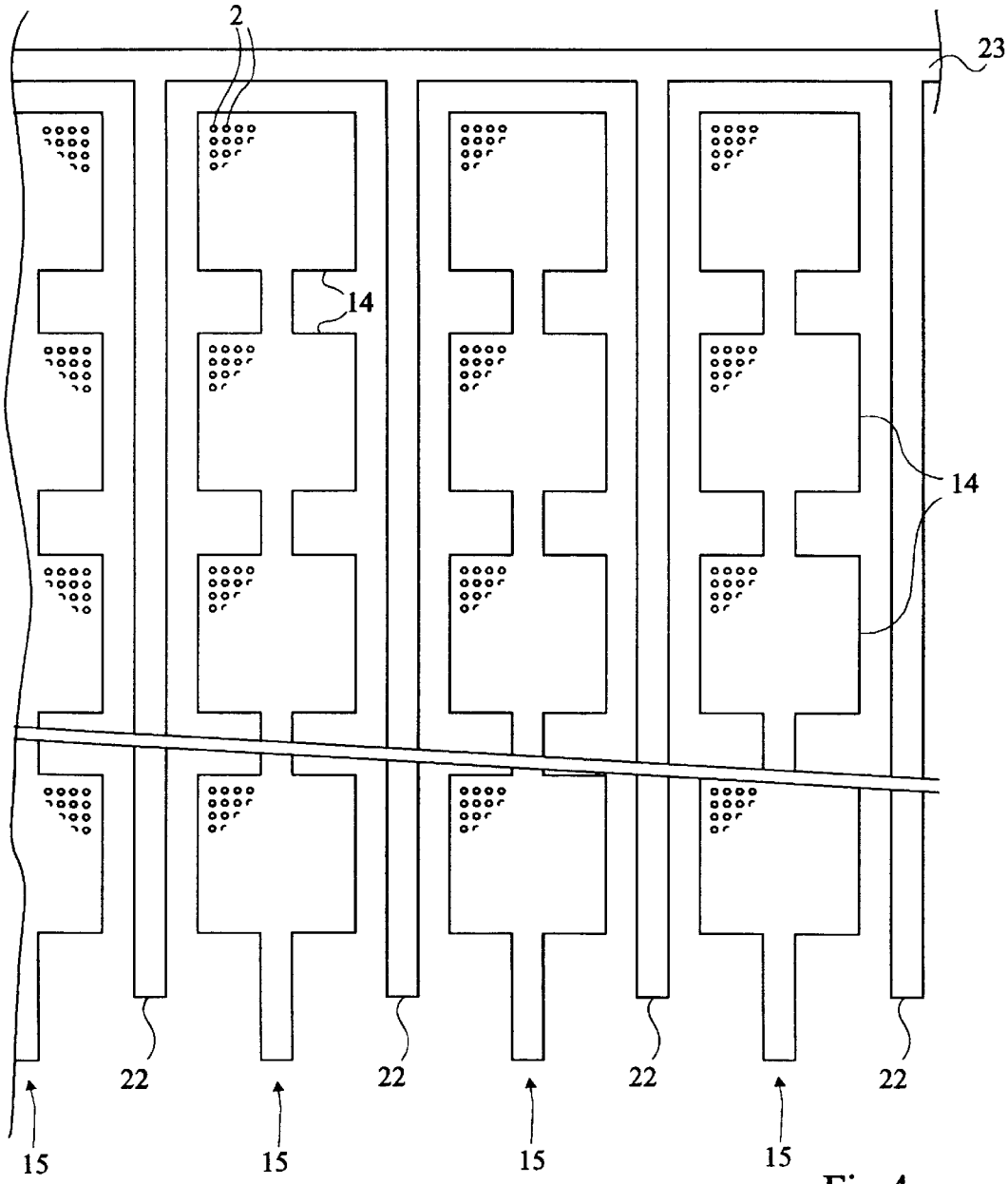
FIG. 4 is a top view of a microtip cathode according to the first embodiment of the present invention.

FIGS. 3 and 4 show a first embodiment of a flat microtip display screen according to the present invention.

Conventionally, cathode 1' is organized in columns 15 and is formed, on a glass substrate 10 (FIG. 3), of cathode conductors organized in meshes from a conductive layer. Microtips 2 are implemented on a resistive layer deposited, for example, on the cathode conductors and are arranged inside the meshes defined by the cathode conductors. In FIGS. 3 and 4, the detail of the structure of columns 15 has not been shown and the cathode conductors associated with the resistive layer have been generally referred to with reference 20. Cathode 1' is associated with a grid 3 organized in lines (not shown in FIG. 4) deposited on an insulating layer 21. Grid layer 3 and insulating layer 21 are open at the locations of microtips 2. For clarity, only four microtips per column have been shown in FIG. 3. It should however be noted that each pixel (14, FIG. 4), defined by the intersection of a column 15 of the cathode with a line of grid 3, comprises several thousands of microtips.

According to the first embodiment of the present invention, conductive tracks are deposited on substrate 10 by interposition between columns 15 of cathode 1'. These tracks 22 are interconnected at one end by means of a track 23 and are biased to a potential at most equal to the minimum biasing potential of columns 15 of cathode 1'.

If the resistive layer is deposited full plate on the cathode conductors, the material constitutive of inter-column tracks 22 can be a conductive material, for example, the same material as that forming the cathode conductors.

If the resistive layer is etched according to the pattern of the cathode columns, inter-column tracks 22 can be formed of the same material as the resistive layer.

In both cases, it will be preferred to use one of the materials constitutive of columns 15 of cathode 1', which has the advantage of not requiring any additional deposition step in the cathode manufacturing. It is enough to modify the etching mask of the different materials to make the pattern of tracks 22 at the same time as that of cathode columns 15.

Thanks to the presence, between two neighboring columns 15, of a track 22 biased to a potential at most equal to the minimum biasing potential of the cathode columns (for example, 0 V), the biasing of a column 15 to a positive potential generates a lateral electric field (arrows 23 in dotted lines in FIG. 3) which closes up through neighboring track 22. Thus, even if the columns around a column biased to a positive potential are at a zero potential, the resistivity of their resistive layer supporting the microtips is not modified by a lateral electric field.

Figure 5:
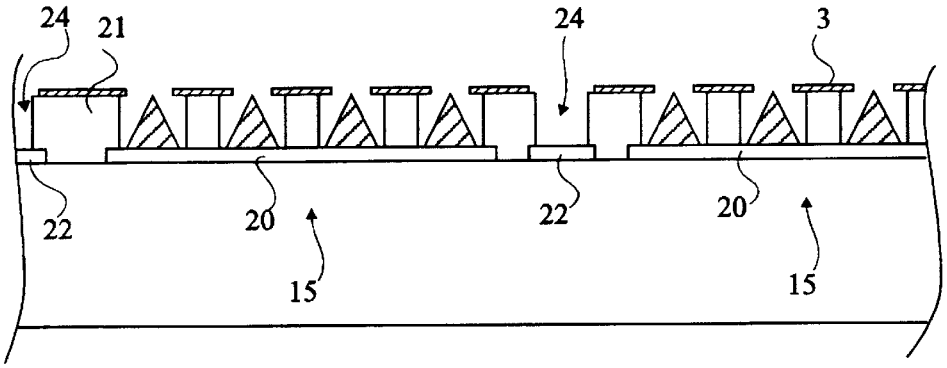
FIG. 5 shows, in cross-sectional view, an alternative of the first embodiment of the present invention.
Figure 6:
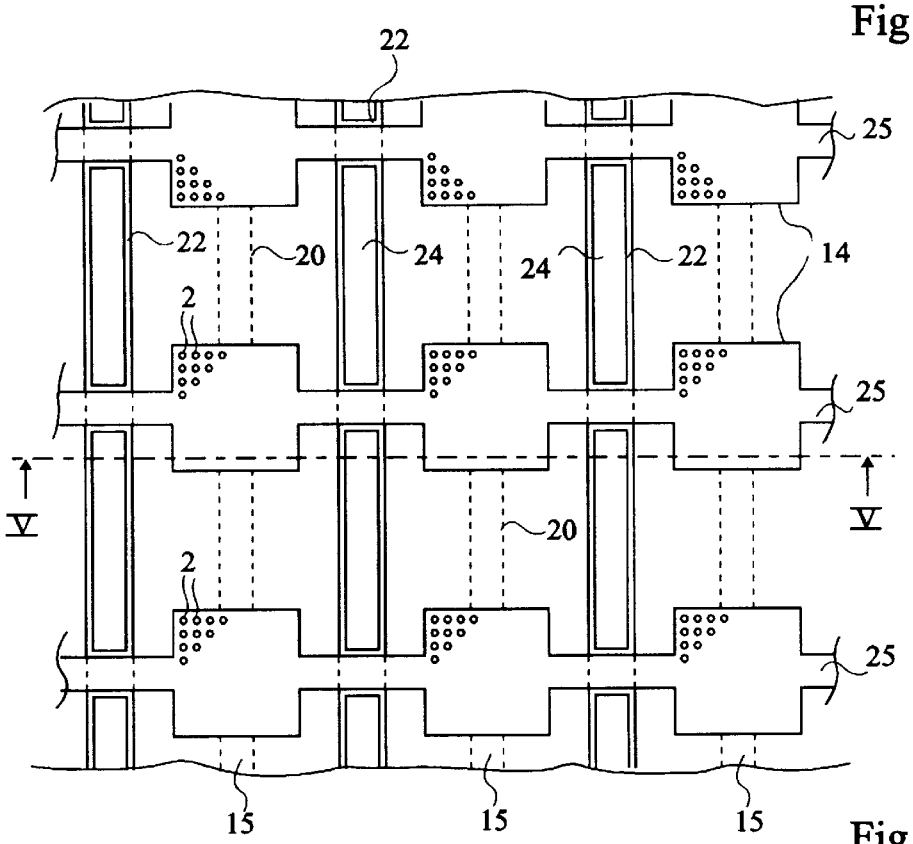
FIG. 6 is a top view of the alternative shown in FIG. 5.

FIGS. 5 and 6 illustrate an alternative of the first embodiment of the present invention. According to this alternative, insulating layer 21, separating cathode conductors 20 from grid 3, has openings 24, at least above inter-column tracks 22.

In FIG. 6, lines 25 of grid 3 have been shown and the section plane of FIG. 5 is illustrated by line V—V in FIG. 6.

An advantage of this alternative is that openings 24 in insulating layer 21 enable that positive ions, which conventionally fall back on the silicon oxide (insulating layer 21) between the pixels and create a charge accumulation on the insulator, are collected by inter-column tracks 22. The occurrence of breakdowns linked with this charge accumulation between the cathode columns is thus avoided.

In the case where the resistive layer (not shown) is deposited full plate over a conductive layer in which are formed the cathode conductors and the inter-column tracks, this resistive layer may, or may not, be opened at the same time as insulating layer 21.

Preferably, insulating layer 21 is not only opened above inter-column tracks 22, but also above cathode conductors 20 (associated or not with a resistive layer), at least between pixels 14, to increase the surface covered by metallic and non-insulating layers, in order to increase the collection of positive charges.

Although the biasing potential of inter-column tracks 22 can be negative, it should be noted that it is enough to avoid the accumulation of charges by the insulating surface and that a biasing of inter-column tracks 22 to 0 volt is enough, since these tracks are conductive.

Figure 7:
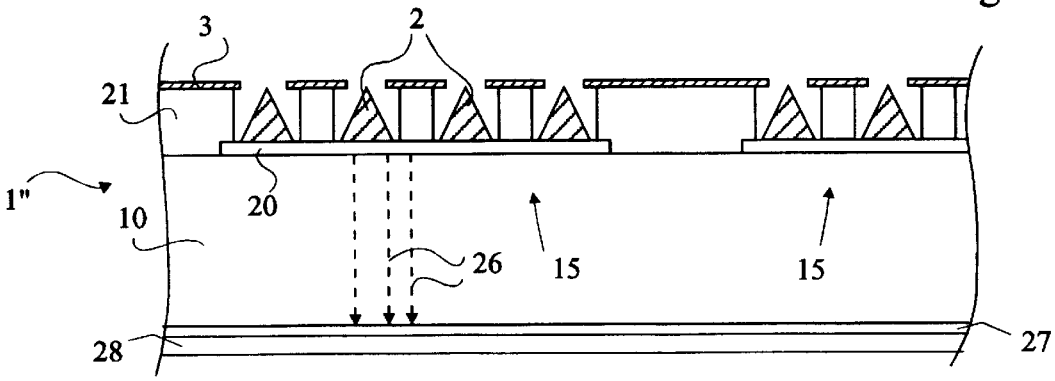
FIG. 7 shows, in cross-sectional view, a second embodiment of a flat display microtip screen according to the present invention.

FIG. 7 illustrates a second embodiment of a microtip cathode of a flat screen according to the present invention.

According to this embodiment, a vertical electric field is created (dotted lines 26) by means of a back-electrode 27 deposited full plate at the rear surface of glass substrate 10 and biased to an adapted potential. Preferably, back-electrode 27 is covered with an insulating protection layer 28.

The biasing potential (for example, on the order of one kilovolt) of back-electrode 27 is chosen to cancel the lateral electric field due to the biasing of columns 15 of cathode 1" and depends, in particular, on the thickness of the glass substrate.

An advantage of this second embodiment is that back-electrode 27 may be used to adjust the resistivity of the cathode columns after the manufacturing of the cathode, to compensate possible manufacturing drifts. For example, the application of a negative potential for a certain duration increases the resistivity of the layer supporting the microtips and, accordingly, will generate a decrease in the general screen luminance. It should be noted that the screen does not require to be in operation for this resistivity adjustment. In particular, the screen anode can be disconnected during this phase.

If desired, the biasing of back-electrode 27 can be periodical during the screen operation.

The choice between the two embodiments of the present invention described hereabove depends on the final functional and structural features desired for the screen. For example, the first embodiment will be chosen if it is not desired to generate an additional potential by means of the electronic screen control circuit (not shown). The second embodiment will be chosen if, for example, it is desired not to modify the front surface of the cathode with respect to a conventional screen.

Of course, the present invention is likely to have various alterations, modifications, and improvements which will readily occur to those skilled in the art. Especially, the different embodiments of the present invention described hereabove may be combined within a same screen. In this case, back-electrode 27 which acts upon the resistivity of layer 11 will be, preferably, used to calibrate the screen brightness at the end of the manufacturing or during maintenance interventions. Then, in normal operation, tracks 22, which have the advantage of giving the cathode a more stable potential electron emission than back-electrode 27, will be used.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A flat display screen cathode comprising:

a substrate;

columns of cathode conductors formed on the substrate, the columns of cathode conductors capable of being biased individually;

a resistive layer deposited on the cathode conductors;

electron emission microtips deposited on the resistive layer; and means for canceling a lateral electric field between two neighboring columns brought to different potentials, the lateral electric field canceling means disposed on the substrate.

2. The cathode of claim 1, wherein the lateral electric field canceling means include inter-column conductive tracks which can be biased to a potential at most equal to the minimum biasing potential of the cathode conductors, each of the inter-column conductive tracks disposed between two neighboring ones of the columns of cathode conductors.

3. The cathode of claim 1, wherein the inter-column conductive tracks are interconnected by one end.

4. The cathode of claim 2, further including an insulating layer formed on the resistive layer, a grid conductive layer organized in lines, the grid conductive layer deposited on the insulating layer, wherein the insulating layer is opened above each inter-column track.

5. The cathode of claim 4, wherein the insulating layer is also opened, at least partially, above the cathode conductors.

6. The cathode of claim 2, wherein the inter-column tracks are deposited directly on the substrate and are made of the same material as the cathode conductors.

7. The cathode of claim 2, wherein the inter-column tracks are deposited directly on the substrate and are made of the same material as that of the resistive layer.

8. The cathode of claim 1, wherein the lateral field canceling means includes a back-electrode deposited at the rear surface of the substrate.

9. The cathode of claim 8, wherein the back-electrode is formed of a conductive plane, extending over the entire surface of the cathode and capable of being biased to a strongly positive potential.

10. The cathode of claim 8, wherein the back-electrode is coated with a protection layer.

* * * * *